US010210852B2

(12) United States Patent
Nannen

(10) Patent No.: US 10,210,852 B2
(45) Date of Patent: Feb. 19, 2019

(54) UKULELE STRAP

(71) Applicant: Melissa Nannen, Bala Cynwyd, PA (US)

(72) Inventor: Melissa Nannen, Bala Cynwyd, PA (US)

( * ) Notice: Subject to any disclaimer, the term of this patent is extended or adjusted under 35 U.S.C. 154(b) by 0 days.

(21) Appl. No.: 15/838,096

(22) Filed: Dec. 11, 2017

(65) Prior Publication Data

US 2019/0005930 A1 Jan. 3, 2019

Related U.S. Application Data

(60) Provisional application No. 62/528,325, filed on Jul. 3, 2017.

(51) Int. Cl.
*G10G 5/00* (2006.01)

(52) U.S. Cl.
CPC ..... *G10G 5/005* (2013.01)

(58) Field of Classification Search
CPC .... G10D 13/02; G10D 13/021; G10D 13/028; G10D 13/023; G10D 13/027; G10D 13/024; G10D 13/026; G10D 13/00
See application file for complete search history.

(56) References Cited

U.S. PATENT DOCUMENTS

| | | | | |
|---|---|---|---|---|
| 4,630,763 | A | 12/1986 | Friedman | |
| 5,332,137 | A | 7/1994 | Violette | |
| 5,596,158 | A | 1/1997 | Tonon | |
| 5,868,293 | A * | 2/1999 | D'Addario ..... | A44B 11/266 224/250 |
| 5,880,385 | A | 3/1999 | Goldin et al. | |
| 6,359,203 | B1 | 3/2002 | Cronos | |
| 7,235,731 | B2 | 6/2007 | Poff | |
| 7,629,523 | B2 | 12/2009 | Neagle | |
| 8,618,393 | B1 | 12/2013 | Peters | |
| 8,975,498 | B2 | 3/2015 | Mullins | |
| 9,070,349 | B1 | 6/2015 | Fischer | |
| 9,257,110 | B1 | 2/2016 | Smith | |
| 9,373,312 | B1 | 6/2016 | Block | |
| 2007/0131085 | A1 | 6/2007 | Abbick | |
| 2011/0186606 | A1 | 8/2011 | Apthorp | |
| 2014/0190331 | A1* | 7/2014 | Mullins ..... | G10G 5/005 84/327 |
| 2015/0302838 | A1 | 10/2015 | Lessard | |

* cited by examiner

*Primary Examiner* — Kimberly Lockett
(74) *Attorney, Agent, or Firm* — Select Patents; Ashkon Cyrus

(57) ABSTRACT

An ukulele strap that works on ukuleles with or without strap buttons installed is disclosed. The apparatus bypasses the need for a strap button, adhesives, or hooks by cinching around the waist of the ukulele and provides full support so that a user can let go of your ukulele with both hands. It also has the option of being converted into a strap with will work with a strap button if a ukulele has that option.

8 Claims, 5 Drawing Sheets

UKULELE STRAP

RELATED APPLICATION

Applicant claims priority of U.S. Provisional Patent Application 62/528,325 filed Jul. 3, 2017, the disclosure of which is hereby incorporated by reference.

TECHNICAL FIELD

The present invention is an improved shoulder strap, particularly a Ukulele strap, and a method of using the same.

BACKGROUND OF THE INVENTION

Traditional ukulele straps only work through use of strap button. However, most ukuleles are manufactured and sold without a strap button which makes attaching available straps very difficult.

Installing a strap button on your ukulele can damage the instrument, so many people prefer to not do that. Other straps that bypass the use of a button do not provide hands free support.

What is needed is a strap which offers several different methods of strapping a ukulele securely and will allow the user to be hands free.

SUMMARY OF THE INVENTION

The present invention is an improved shoulder strap that works on ukuleles with or without strap buttons. In one embodiment, the ukulele strap bypasses the need for a strap button, adhesives, or hooks on a ukulele by cinching around the waist of the ukulele and provides full support so that a user can let go of the ukulele with both hands.

The apparatus also has the option of strapping to a ukulele with no strap buttons or with a single strap button. A further embodiment provides the option of strapping to a ukulele with two strap buttons.

An object of the invention is to offer several different methods of strapping a ukulele so that it will work in almost all situations. It will hold the ukulele securely and will allow the user to be hands free. A more complete understanding of the invention, including an understanding of the various configurations of length-adjustable straps, will be afforded to those skilled in the art, as well as a realization of additional advantages and objects thereof, by consideration of the followed detailed description. Reference will be made to the appended drawing sheets which will first be described briefly.

BRIEF DESCRIPTION OF THE DRAWINGS

The drawings described herein are for illustrative purposes only and are not intended to limit the scope of the present disclosure. In the drawings, wherein like reference numerals refer to similar components.

DETAILED DESCRIPTION OF THE INVENTION

The following detailed description includes references to the accompanying drawings, which form a part of the detailed description. The drawings show illustrations in accordance with example embodiments.

The shoulder strap is illustrated in FIGS. 1 through 5. The strap may be adapted to fit and secure firmly to the headstock and body of a ukulele. Alternatively, the strap may have adjustable sizing so as to fit many various body styles, shapes, or widths. An adjustable strap is illustrated in the accompanying figures. The shoulder strap allows any ukulele or banjolele player to use this strap on any ukulele provided it either has a waist, a strap button(s), or drum hardware (banjolele). It works in four primary configurations, illustrated in FIGS. 2-5:

1. No strap button configuration with waisted ukulele: Attaches at headstock with headstock strap and wraps around the waist of the ukulele, and cinches tight with a square slide.
2. One strap button configuration: Attaches at headstock with headstock strap and attaches at a strap button or endpin located at the ukulele's base.
3. Two strap button configuration: The headstock strap is removed via a buckle, strap is attached directly to strap buttons located at the neck of the instrument as well as at the base.
4. Banjolele: Attaches at headstock with headstock strap via square slide and wraps around the drum hardware at base of banjolele, cinches tight with square slide.

Figure 1:
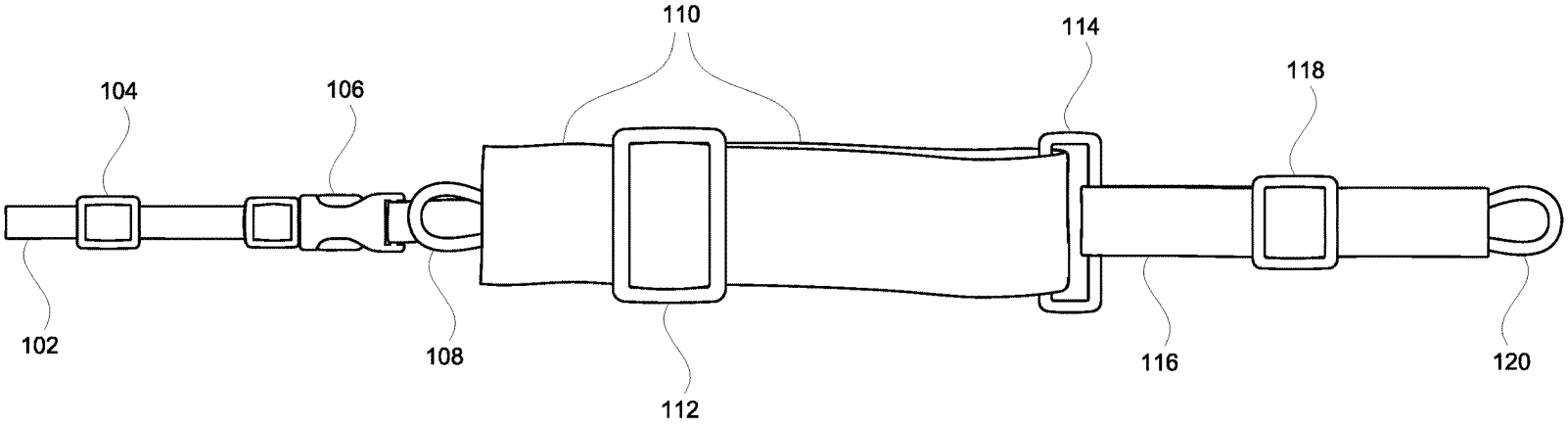
FIG. 1 illustrates a shoulder strap according to an aspect of the invention.

FIG. 1 illustrates the shoulder strap according to an aspect of the invention. In a first embodiment, the strap consists of three primary pieces: a headstock strap 102, a cinch strap 116 for wrapping around the waist of the body of the ukulele, and a middle adjustable strap 110. The material for these straps can be webbing or fabric. The material for these straps can also be made out of leather.

The headstock strap 102 is adapted to be looped around the headstock of the instrument via a slide 104. The cinch strap 116 is adapted to be placed around the waist of the instrument via a slide 118. The slides can be triglide slides or square slides. The headstock strap 102 is attached to a middle adjustable strap 110. In this embodiment, the headstock strap 102 is attached to the middle adjustable strap 110 via a side release buckle 106. Alternative embodiments for attachment include front release buckles, cam buckles, and various other means of strap and buckle hardware known in the art. The buckle 106 allows you to detach the headstock strap when using a two strap button configuration. In an alternative embodiment, the headstock strap is directly sewn into the middle adjustable strap. In this alternative embodiment, the strap allows you to only attach at the headstock and either at the base via a strap button or by using the loop that goes around the body of the ukulele. It can be appreciated that either configuration allows for adjustment through the middle adjustable strap 110 as well as the headstock strap 102.

A large slide 112 is attached onto the other end of the middle adjustable strap 110. The middle adjustable strap 110 is threaded through a loop 114 and then threaded into both ends of the large triglide slide 112 and pulled taut. It can be appreciated that this configuration allows for adjusting the length of the middle adjustable strap. The cinch strap 116 is attached to loop 114. In one embodiment, the cinch strap is attached via sewing to loop 114.

Loop 108 (attached to middle adjustable strap 110) and loop 120 (attached to cinch strap 116) are configured to be attached to strap buttons for use in the various strap button configurations. In one embodiment, the loops are made of parachute cords.

Figure 2:
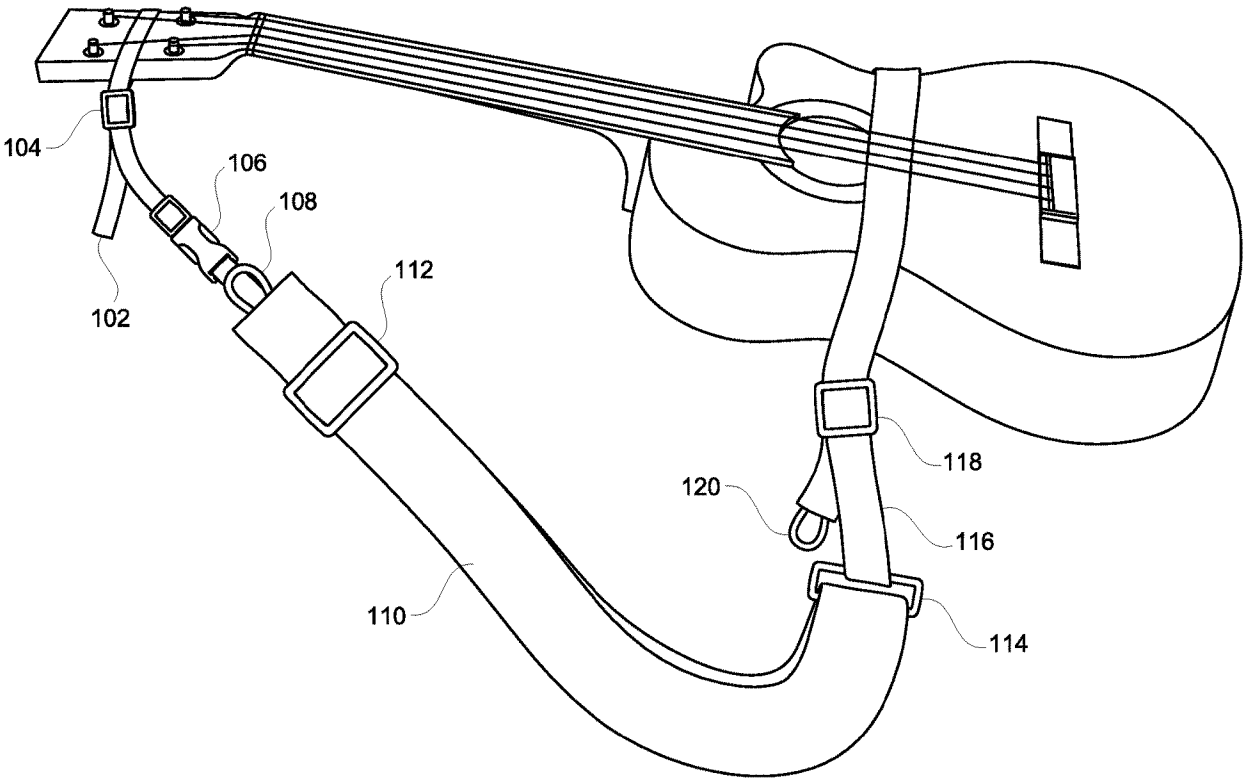
FIG. 2 illustrates a shoulder strap in a no strap button configuration according to an aspect of the invention.

FIG. 2 illustrates a shoulder strap in a no strap button configuration according to an aspect of the invention. It can be appreciated that this embodiment allows a user to strap a ukulele without need for installing a strap button or endpin on the ukulele. The headstock strap 102 can be threaded away from a user underneath the strings of a headstock of the ukulele either between the tuning pegs or next to the nut. The headstock strap 102 is then looped underneath the headstock and threaded into both sides of the slide 104 and pulled taut to the headstock. The cinch strap 116 is threaded underneath the strings at the waist of the ukulele and pulled underneath the body and then threaded into both ends of the slide 118 and pulled taut against the body of the ukulele. Additional adjustments to the length of the strap are made through use of the large triglide slide 112 on the middle adjustable strap 118.

Figure 3:
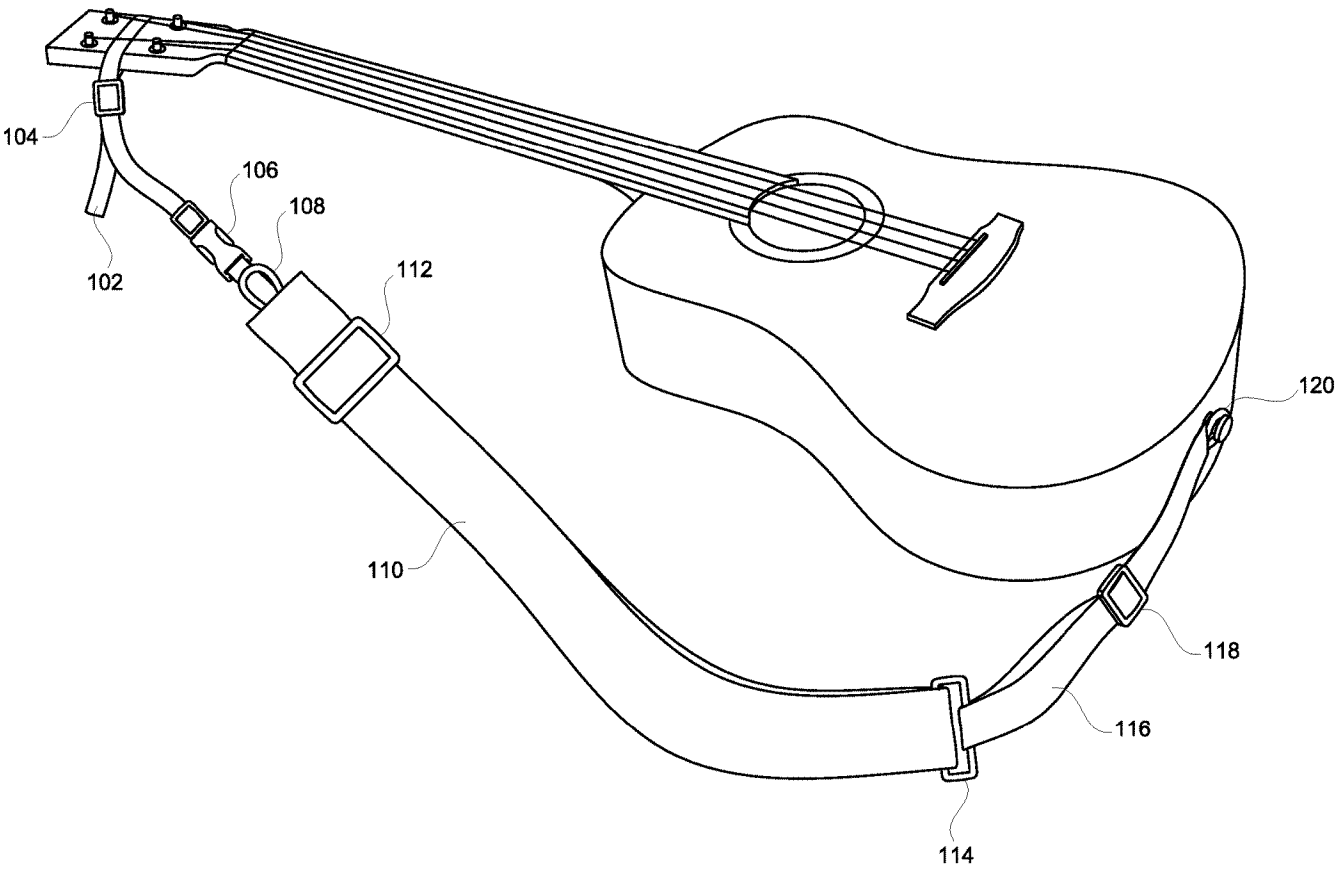
FIG. 3 illustrates a shoulder strap in a one strap button configuration according to an aspect of the invention.

FIG. 3 illustrates a shoulder strap in a one strap button configuration according to an aspect of the invention. This configuration is for a ukulele with a single strap button at the end of the instrument, where the cinch strap 116 could be attached around the waist of the ukulele through use of the loop 120.

The headstock strap 102 is threaded away from underneath the strings of the headstock of the ukulele either between tuning pegs or next to the nut. It is then looped underneath the headstock and threaded into both sides of the triglide slide 104 and pulled taut to the headstock, just like in the no strap button configuration. The cinch strap 116 is threaded through the loop or slide 114 and on top of and into both sides of the triglide slide 118 and pulled taut to the desired length. The loop 120 on the cinch strap 116 is attached to the strap button at the bottom of the invention by looping it around the strap button.

Figure 4:
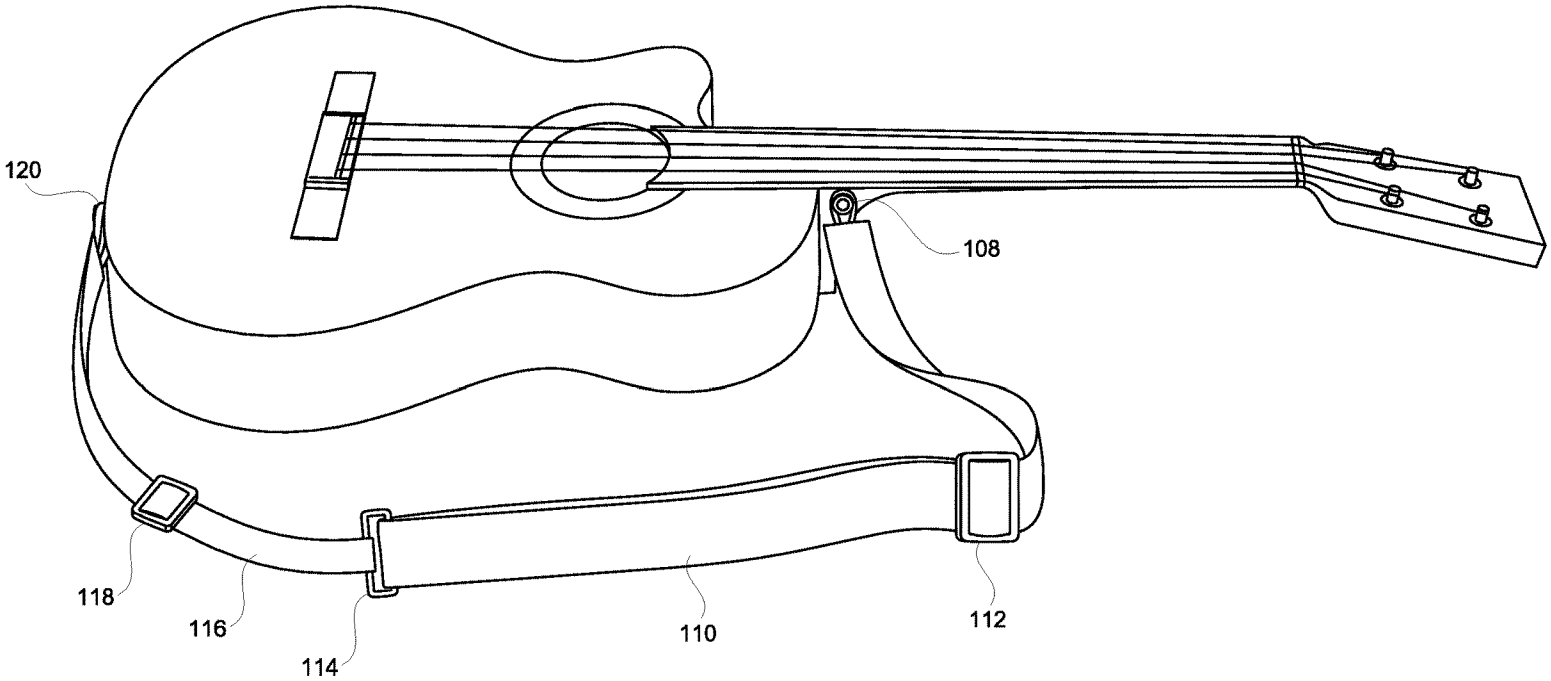
FIG. 4 illustrates a shoulder strap in a no two button configuration according to an aspect of the invention.

FIG. 4 illustrates a shoulder strap in a two button configuration according to an aspect of the invention. The headstock strap has been removed via the buckle 106, and the strap is attached via parachute cord loops 108 and 120 at either end of the strap to the strap buttons located at the neck of the instrument as well as at the base.

Figure 5:
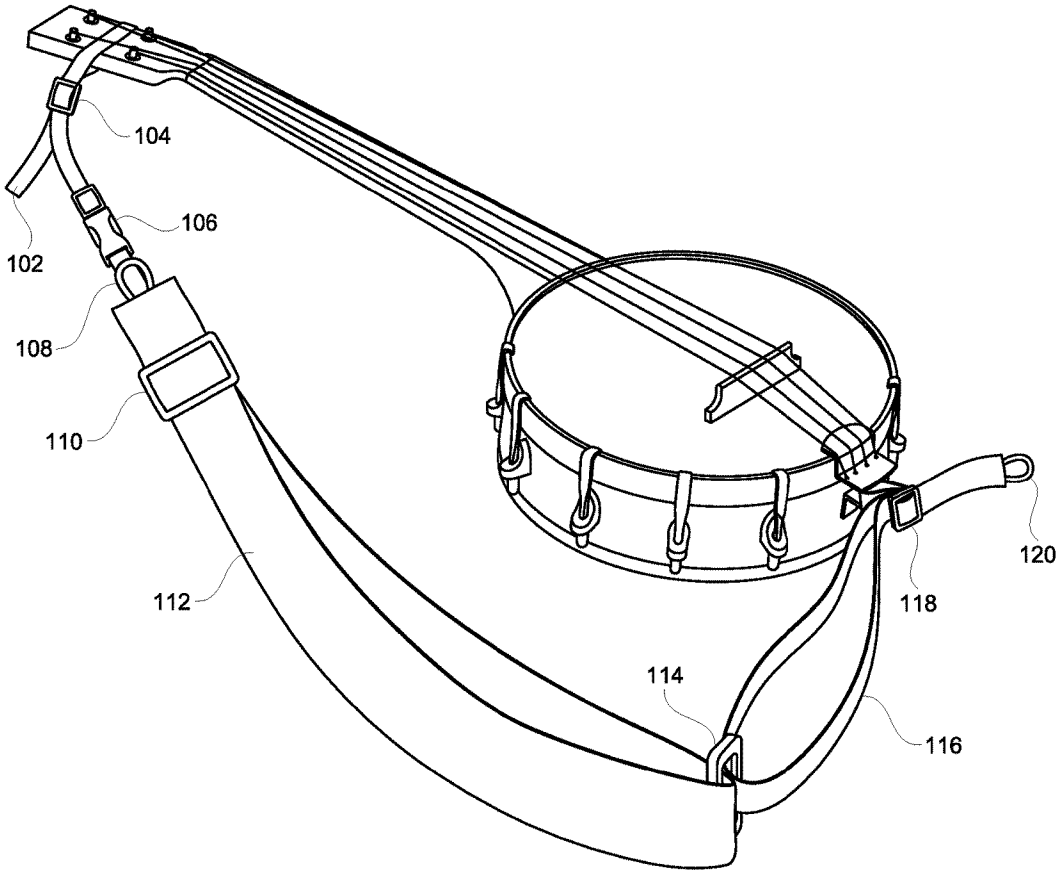
FIG. 5 illustrates a shoulder strap in a banjolele configuration according to an aspect of the invention.

FIG. 5 illustrates a shoulder strap in a banjolele configuration according to an aspect of the invention. This configuration attaches at the headstock with the headstock strap 102 via the square slide 104 and wraps around the drum hardware at base of banjolele, and cinches tight with the square slide 118.

All elements are necessary to allow the strap to operate with ukuleles of all types. In a further embodiment, a grippy fabric could be adhered in some manner to the narrow fabric or webbing cinch strap for use with pineapple shaped ukuleles.

It can be appreciated that the apparatus presently disclosed allows the strap the ability to be used in at least three different configurations: no strap button, one strap button, and two strap button. It also provides for use with a banjolele instrument. It can be further appreciated that the strap can be attached to a ukulele in any of the configurations as described above and adjusted to fit the individual. A user could put the strap over their head and put their strumming arm through the loop created so it works like a traditional guitar strap. They could pull the strap taut at the slides as needed to make the strap fit their body and hold the ukulele tightly so it doesn't slip or move.

Various illustrative implementation of the present invention have been described. However, one of ordinary skill in the art, in light of the teachings herein, will recognize that additional implementations are also possible and within the scope of the present invention.

For example, other methods of attachment to the instrument could be used. The method of attachment used to secure to the ukulele strap buttons can contain either parachute cord loops as illustrated in the figures, or could be locking devices that would lock in to the ukulele strap buttons.

Several alternative methods of attaching the strap to the instrument could be used such, as a device that would lock in to the instrument, buckle to the instrument, or snap in to the instrument. The strap could be made to use various methods for securing it to the instrument such as a buckle, velcro (hook and loop fastener), or other method. Materials used to make the strap could also be of any soft but durable type that would add to the comfort and support of the strap. The width of the middle adjustable strap could also vary such as being wider in the back and narrower in the front to allow for more comfort and support.

Additionally, the cinch strap itself is not limited to the specific implementation presented herein. The cinch strap can vary in size and shape and includes any device that is made to fit securely to the body of a ukulele and that does not require making any modifications to the ukulele. In place of using a cradle, the belt can use a strap button positioned near the middle underside portion of the guitar.

Thus, this invention is not limited to using the particular elements, materials, or components described herein, and other elements, materials, or components will be equivalent for the purposes of this invention. Accordingly, it is understood that the drawings and the descriptions herein are proffered only to facilitate comprehension of the invention and should not be construed to limit the scope thereof.

The invention claimed is:

1. A apparatus, comprising:

a headstock strap adapted to be placed around the headstock of a ukulele or banjolele instrument; a middle adjustable strap; a cinch strap adapted to be placed around the waist of the instrument, wherein the cinch strap is secured to the middle adjustable strap and wherein the cinch strap further comprises a strap loop that can attach to a first strap button located at a base of the instrument; means for connecting the headstock strap to a first end of the middle adjustable strap.

2. The apparatus of claim 1, wherein the headstock strap is adapted to be placed around the headstock of the instrument by looping around the headstock via a square slide.

3. The apparatus of claim 2, wherein the cinch strap is secured to the middle adjustable strap by threading the middle adjustable strap through a loop attached to the cinch strap and then into a second square slide located on the middle adjustable strap.

4. The apparatus of claim 3, wherein the means for connecting comprises a locking device, a snap, a buckle, or a button.

5. The apparatus of claim 3, wherein the means for connecting comprises a buckle, and wherein the first end of the middle adjustable strap further comprises a second strap loop that can attach to a second strap button located at a neck of the instrument.

6. The apparatus of claim 5, wherein the cinch strap is adapted to be used with pineapple shaped ukuleles that have no waist by including a grippy fabric on the cinch strap.

7. The apparatus of claim 5, wherein the cinch strap is adapted to be placed around a drum hardware at base of the instrument and cinches tight with a square slide.

8. The apparatus of claim 5, wherein the first strap loop and second strap loop further comprise parachute cord loops.

* * * * *